US006019175A

United States Patent [19]

Haynes

[11] Patent Number: 6,019,175

[45] Date of Patent: Feb. 1, 2000

[54] TUBING HANGER TO PERMIT AXIAL TUBING DISPLACEMENT IN A WELL BORE AND METHOD OF USING SAME

[76] Inventor: Michael Jonathon Haynes, Box 12, Site 7, R.R. #3, Innisfail, Alberta, Canada, T4G 1T8

[21] Appl. No.: 09/024,534

[22] Filed: Feb. 17, 1998

[51] Int. Cl.[7] ..... E21B 23/00

[52] U.S. Cl. ..... 166/382; 166/77.51; 166/334.1; 166/387

[58] Field of Search ..... 166/77.51, 334.1, 166/381, 382, 387

[56] References Cited

U.S. PATENT DOCUMENTS

| | | | |
|---|---|---|---|
| 3,646,995 | 3/1972 | Manes et al. | 166/336 |
| 3,791,449 | 2/1974 | Cochran | 166/381 X |
| 3,830,306 | 8/1974 | Brown | 166/334.2 X |
| 4,403,654 | 9/1983 | Haynes . | |
| 4,546,830 | 10/1985 | McLaughlin et al. . | |
| 5,049,037 | 9/1991 | Carson et al. . | |
| 5,443,120 | 8/1995 | Howell . | |
| 5,465,788 | 11/1995 | Wright . | |
| 5,579,838 | 12/1996 | Michael . | |

*Primary Examiner*—Roger Schoeppel
*Attorney, Agent, or Firm*—Dority & Manning, P.A.

[57] ABSTRACT

A tubing hanger and a method for axially displacing tubing string in a cased well bore without removing the wellhead from the well are described. The tubing hanger consists of a primary tubing hanger component engageable with the wellhead and a secondary tubing hanger component removably received in the cavity of the primary tubing hanger component. When downhole operations require axial displacement of the tubing string, the secondary tubing hanger component is disengaged from the primary tubing hanger component and stroked up through the wellhead to permit tubing joints to be added or removed. Such axial displacement of the tubing string facilitates downhole operations such as the repositioning of a zone isolating tool, the logging of a production zone, the removal of debris such as sand from a sand trap, selective stimulation of a production zone, and other localized downhole operations which require or are facilitated by tubing string manipulation. The advantage is the ability of axially displace the tubing string without removing the wellhead which saves time and significantly reduces costs.

30 Claims, 3 Drawing Sheets

TUBING HANGER TO PERMIT AXIAL TUBING DISPLACEMENT IN A WELL BORE AND METHOD OF USING SAME

TECHNICAL FIELD

This invention relates generally to wellhead equipment and, in particular, to an apparatus and method for axially displacing tubing string in a cased well having a wellhead.

BACKGROUND OF THE INVENTION

In a cased well equipped with a wellhead, tubing strings are supported by a tubing hanger which is in turn supported by a tubing head in a manner well known in the art. Tubing heads are generally mounted to a surface flange of the cased well. The tubing hanger is received in the tubing head and locked in position by lock-down screws to ensure that the tubing hanger is not ejected from the tubing head if the well is subjected to significant fluid pressure. The tubing string is generally suspended by threaded attachment to the tubing hanger. The position of a bottom end of the tubing string is therefore fixed and determined by the length of the string. In order to change a position of the bottom end of the tubing string, a complicated process must be undertaken which involves removal of the wellhead and the tubing hanger. Before the wellhead can be removed, it is usually necessary to "kill" the well by overburdening any natural pressure to ensure that hydrocarbons do not escape from the well when the wellhead is removed. Operations such as killing a well and removing a wellhead require considerable time and generally involve the use of a derrick or a rig in order to handle components and ensure safety. Such operations therefore require the engagement of complex equipment and skilled labour which involves considerable expense.

It is therefore desirable to provide a method and apparatus to permit the axial displacement of a tubing string in a cased well bore without removal of the wellhead or necessity for killing the well. One such apparatus is described in applicant's copending patent application Ser. No. 08/946,510 entitled TELESCOPING JOINT FOR USE IN A CONDUIT CONNECTED TO A WELLHEAD AND ZONE ISOLATING TOOL FOR USE THEREWITH which was filed on Oct. 7, 1997. The disclosure of that application is incorporated herein by reference in its entirety. An apparatus for use in moving tubing connected to the telescoping joint was described in applicant's copending application Ser. No. 08/992,235 entitled APPARATUS FOR AXIALLY DISPLACING A DOWNHOLE TOOL OR A TUBING STRING IN A WELL BORE which was filed on Dec. 17, 1997. The disclosure of that application is likewise incorporated herein by reference in its entirety.

Although the telescoping joint described above greatly facilitates certain downhole operations, the axial displacement of a tubing string which may be achieved using the telescoping joint is limited by a length of the telescoping joint(s) in the tubing string. While that limited range of axial displacement is adequate for most downhole operations that require displacement of a bottom end of the tubing string, it is sometimes desirable to be able to displace the bottom end of the tubing string over a greater distance than is economically afforded by a telescoping joint(s).

There therefore exists a need for an apparatus and method which permits axial displacement of a tubing string in a cased well bore over a range which is practically limited only by the length of the tubing string itself.

SUMMARY OF THE INVENTION

It is therefore an object of the invention to provide a tubing hanger for enabling the axial displacement of a tubing string in a well bore without removing the wellhead from the well.

It is a further object of the invention to provide a tubing hanger to permit axial displacement of the tubing string through the wellhead.

It is yet a further object of the invention to provide a method of axially displacing a tubing string in a cased well bore without removing a wellhead from the well.

It is yet a further object of the invention to provide a method and a tubing hanger for facilitating downhole operations which involve axial displacement of a tubing string in a well bore.

The objects of the invention are enabled by a hanger for a tubing string in a cased well equipped with a wellhead, to permit axial displacement of the tubing string up through the wellhead, comprising:

a first hanger part engageable with the wellhead for detachably supporting a second hanger part;

the second hanger part being adapted for hanging the tubing string and sized to be stroked up through a central passage in the wellhead with the tubing string attached; and a fluid seal located between the first and second hanger parts to inhibit a flow of fluids therebetween when the first hanger part supports the second hanger part.

The objects of the invention are further enabled by a method of axially displacing a tubing string in a cased well bore without removing a wellhead from the well, comprising the steps of:

a) equipping the wellhead with a tubing hanger which includes at least a first hanger part supported by the wellhead and a second hanger part supported by the first hanger part, the second hanger part supporting the tubing string and sized to be stroked up through a central passage of the wellhead;

b) inserting a latch for connecting to the second hanger part or the tubing string through the wellhead, and connecting the latch to the tubing string or the second hanger part; and c) stroking the second hanger part of the tubing hanger and a portion of the tubing string through the wellhead.

The invention therefore provides a novel construction for a tubing hanger which permits axial tubing displacement in a well bore and a method of using the tubing hanger to perform downhole operations which require or are facilitated by, axial displacement of the tubing string. Such operations include the logging of a well bore; the positioning of a zone isolating tool to selectively produce a fluid of interest from a well bore; the removal of debris such as sand from a bottom of the well bore; selective stimulation of a production zone using a zone isolating tool; the removal of paraffin or hydrates from a portion of the bore; or any other downhole operation in which a tubing string is advantageously axially displaced to enable or facilitate a downhole operation.

The tubing hanger in accordance with the invention comprises at least a first hanger part hereinafter referred to as the primary tubing hanger component, and a second hanger part, hereinafter referred to as the secondary tubing hanger component. The primary tubing hanger component is supported by a tubing head in a manner well known in the art. The secondary tubing hanger component is preferably supported in a cavity formed in the primary tubing hanger component. Lock means are provided between the primary and secondary tubing hanger components to ensure that the secondary tubing hanger component cannot be ejected from wells having high natural pressure or high induced pressure. A fluid seal is provided between the first and second tubing hanger components to inhibit the migration of fluids between the components. The fluid seal is preferably carried in grooves formed in an outer surface of the secondary tubing hanger component.

The secondary tubing hanger component supports the tubing string, preferably by threaded connection. The secondary tubing hanger component is sized to enable it to be stroked up through a central passage in the wellhead.

The tubing hanger in accordance with the invention can be manufactured to fit most commercially available tubing heads.

BRIEF DESCRIPTION OF THE DRAWINGS

The invention will now be further explained by way of example only and with reference to the following drawings wherein.

DETAILED DESCRIPTION OF THE PREFERRED EMBODIMENT

Figure 1:
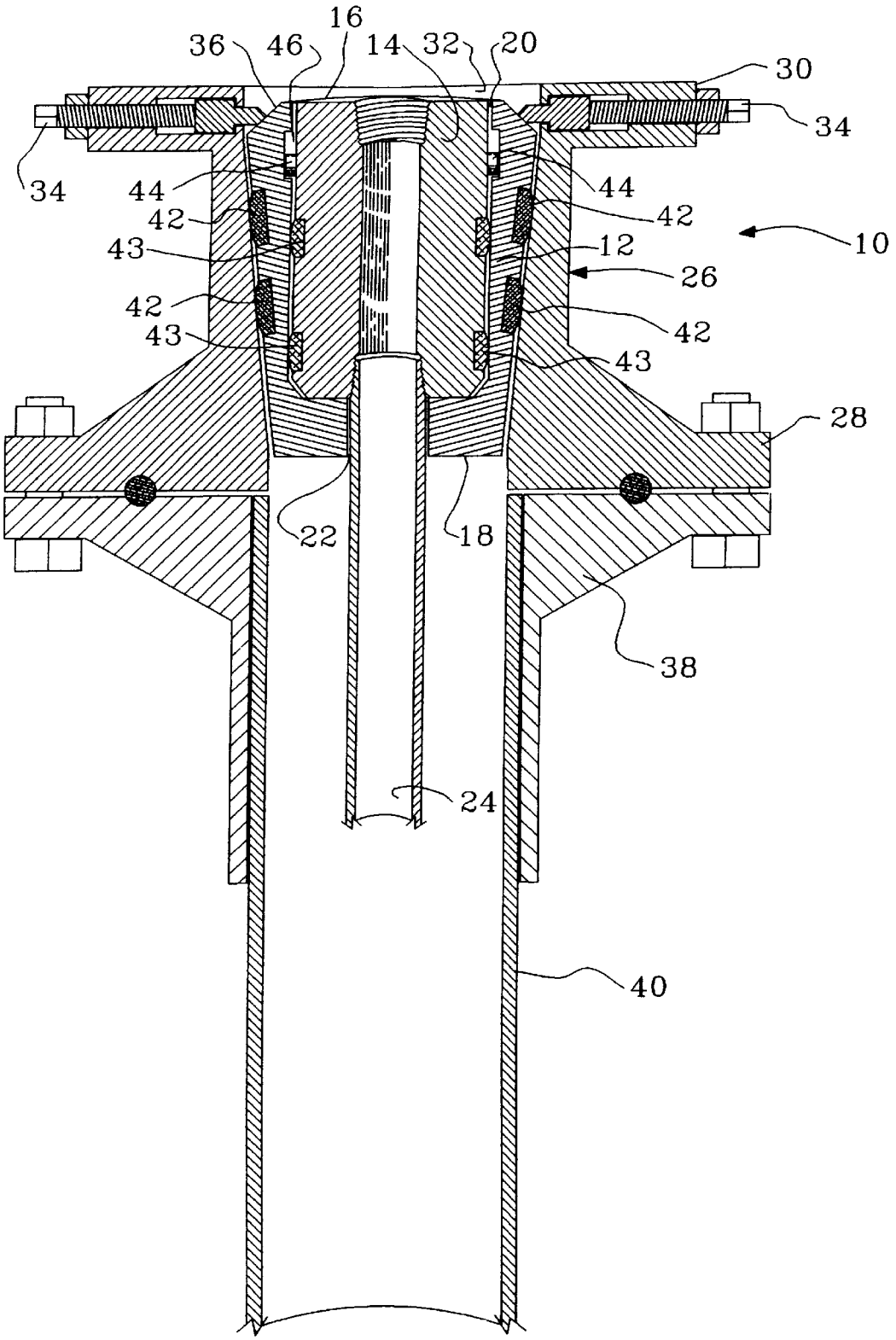
FIG. 1 is a cross-sectional view of a first embodiment of a tubing hanger in accordance with the invention supported in a tubing head mounted to a surface flange of a cased well.

FIG. 1 is a cross-sectional view of a tubing hanger in accordance with the invention, generally indicated by the reference 10. The tubing hanger 10 includes a first hanger part which is referred to below as the primary tubing hanger component 12 and a second hanger part which is referred to below as the secondary tubing hanger component 14. The primary tubing hanger component 12 is substantially frustoconical and has a top end 16 and a bottom end 18. A cavity 20 is formed in the top end 16 of the primary tubing hanger component 12. A passage 22 is formed through the bottom end 18 of the primary tubing hanger component 12. The passage 22 is sized to permit a tubing string 24 to reciprocate therethrough. The primary tubing hanger 12 is supported by a tubing head generally indicated by the reference 26. The tubing head 26 includes a bottom flange 28, a top flange 30 and an internal passage 32. The internal passage 32 may include seals or stops not shown in this drawing but well known in the art. The top flange 30 generally includes a plurality of lock-down screws 34. The lock-down screws 34 engage a bevelled shoulder 36 of the primary tubing hanger component 12. This locks the primary tubing hanger component 12 within the tubing head 26 to ensure that it is not ejected by fluid pressure in the well bore. Lock-down screws 34 also frequently serve the purpose of energizing fluid seals. The tubing head 26 is usually mounted to a casing head 38 that is schematically illustrated in cross-sectional view. The casing head 38 is connected to the casing 40 of the cased well bore. Components such as a bit guide, etc. standard in wellhead constructions are not illustrated.

As described above, the secondary tubing hanger component 14 is received in the cavity 20 formed in the top surface 16 of the primary tubing hanger 12. The shape of the cavity 20 and the shape of the secondary tubing hanger component 14 are matters of design choice. It is only important that the secondary tubing hanger component 14 be robust enough to support the tubing string 24 while being sized to enable the secondary tubing hanger component 14 to be stroked through a central passage of the wellhead (not illustrated).

Fluid seals are provided between the tubing head 26 and the primary tubing hanger component 12, as well as between the primary tubing hanger component 12 and the secondary tubing hanger component 14. The position and composition of the fluid seals are partially dependent on matters of design choice and partially dependent on fluid pressure and fluid composition in the well bore. The embodiments shown in FIG. 1 have fluid seals 42 to inhibit the flow of fluids from the annulus of casing 40 between the primary tubing hanger 12 and the tubing head 26. The fluid seals 42 are typically an elastomeric composition compatible with the composition and the pressure in the well bore. For high-pressure applications, metal-to-metal seals may also be used. As will be understood by those skilled in the art, the fluid seals may be borne by the tubing head 26, the primary tubing component 12, or both.

Fluid seals 43 inhibit a flow of fluids from the annulus of the casing 40 between the primary tubing hanger component 12 and the secondary tubing hanger component 14. The composition, structure and position of the fluid seals 43 are likewise dependent on a combination of design choice and the pressure and composition of the fluids in the well bore. The design and selection of such fluid seals are well understood in the art and will not be further explained for that reason.

The secondary tubing hanger component 14 is preferably locked in the cavity 20 of the primary tubing hanger component 12 to ensure that it is not ejected by fluid pressure in the well. The mechanism for locking the secondary tubing hanger component 14 in the cavity 20 is a matter of design choice. In the preferred embodiment of the invention, the lock is provided by an opposed pair of locking pins 44 which are received in complimentary J-shaped slots 46. The slots 46 in combination with the locking pins 44 provide a J-latch, well known in the art. As will be understood by persons skilled in the art, the pins 44 may be mounted to either of the secondary tubing hanger component 14 or the primary tubing hanger component 12 and the J-shaped slots 46 can be formed in the other of the two components. Other lock-down arrangements can also be used. For example, the secondary tubing hanger component 14 and the primary tubing hanger component 12 may be complimentarily threaded so that they are locked together by threaded engagement. As another example, threaded lock-down screws which extend through the tubing head 26 and the primary tubing hanger component 12 may be used to lock the secondary tubing hanger component in the cavity 20. As will be understood by those skilled in the art, a collet, slip, or key-type connection may also be used to lock together the primary tubing hanger component 12 and the secondary tubing hanger component 14. If the tubing hanger 10 in accordance with the invention is to be used in wells with little or no natural pressure, the weight of the tubing string 24 may be adequate to retain the secondary tubing hanger component 14 within the cavity 20, but a positive lock mechanism is preferred.

Figures 2, 3:
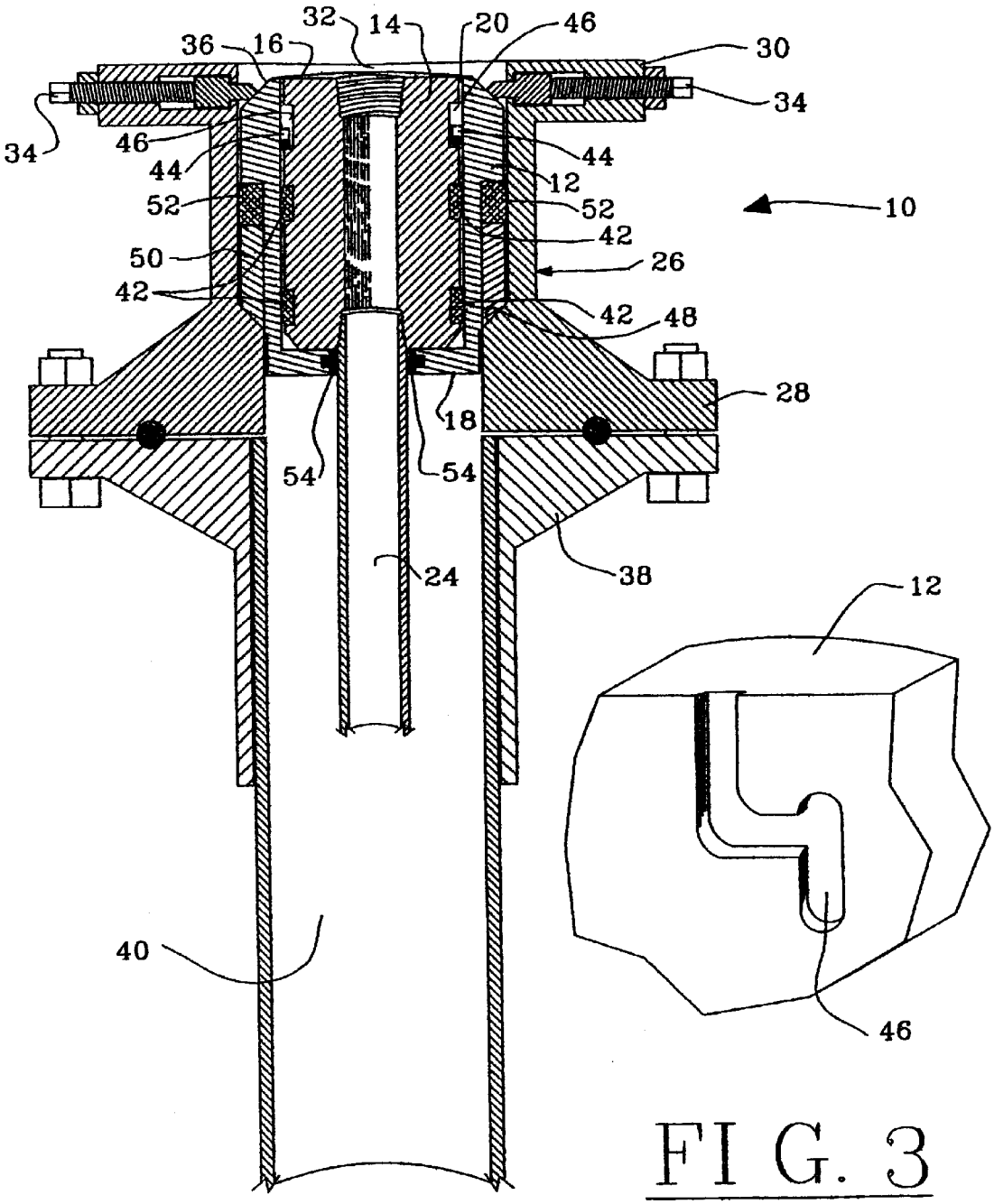
FIG. 2 is a cross-sectional view of a second embodiment of a tubing hanger in accordance with the invention supported by a tubing head mounted to a surface flange of a cased well.
FIG. 3 is a perspective view of a J-latch preferably used to lock the secondary tubing hanger component within the primary tubing hanger component of a tubing hanger in accordance with the invention.

FIG. 2 shows a second configuration for the tubing hanger 10 in accordance with the invention. In this embodiment, the primary tubing hanger component 12 is substantially cylindrical rather than substantially frustoconical. The primary tubing hanger component 12 is retained in the tubing head 26 by an internal shoulder 48 which is typically inclined at 45°. This embodiment of the tubing hanger 10 is designed for high-pressure applications. The primary tubing hanger component 12 has an external sleeve 50 which compresses a fluid seal 52 against a wall of the internal passage 32 of the tubing head 26, in a manner well known in the art. The fluid seal 52 may be an elastomer band or the like.

A further feature of the embodiment shown in FIG. 2 is that fluid seals 54 seal the passage 22 to contain fluid pressure in the annulus of the casing 40 while the tubing string 24 is being stroked out of the well, as will be explained below in more detail with reference to FIG. 4. In other respects, the embodiment shown in FIG. 2 is substantially the same as the embodiment described above with reference to FIG. 1.

FIG. 3 shows a perspective view of the J-shaped slot 46 of the J-latch preferably used to lock the secondary tubing hanger component 14 within the cavity 20 of the primary tubing hanger component 12. As described above, the J-shaped slots 46 may be machined in either the primary tubing hanger component 12 (see FIG. 1) or the secondary tubing hanger component 14 (see FIG. 2). The shape of the J-shaped slot 46 is also a matter of design choice, as will be well understood by those skilled in the art. As described above, the secondary tubing hanger component 14 may also be secured within the cavity 20 of the primary tubing hanger component 12 using other securing mechanisms, including a collet or slip-type connector; a threaded connection; a key-type connector or lock-down screws, which are not illustrated but are respectively well known in the art.

As explained above, the axial displacement of a tubing string in a well bore permits or facilitates various downhole operations including: well completion; well bore workovers; well abandonments; wirelining for logging or the like; drilling for barefoot completions or the like; production testing using zone isolation tools or the like; and, any other downhole process in which axial displacement of a tubing string is desirable or necessary.

In order to axially displace the tubing string within the well bore, a rig or a derrick may be used but the operation is most economically and preferably accomplished using the apparatus described in applicant's copending application entitled APPARATUS FOR AXIALLY DISPLACING A DOWNHOLE TOOL OR TUBING STRING IN A WELL BORE which was filed on Dec. 17, 1997.

Figure 4:
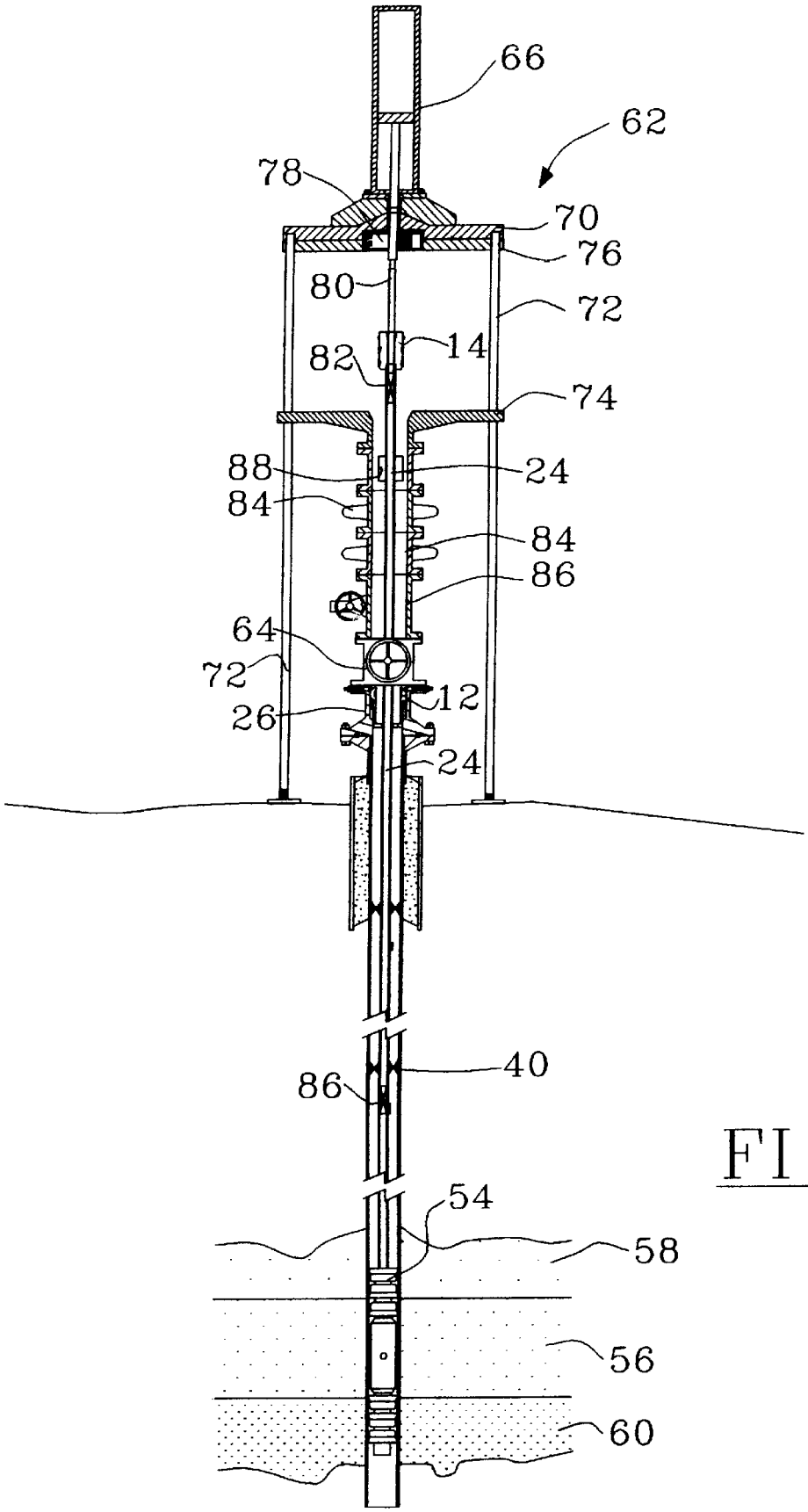
FIG. 4 is a cross-sectional view of a cased well equipped with a tubing hanger in accordance with the invention and a lifting apparatus preferably used for axially displacing the tubing string within the cased well bore.

FIG. 4 is a schematic cross-sectional view of that apparatus being used to axially displace tubing string 24 in the casing 40. The tubing string 24 supports a zone isolating tool 54 described in applicant's copending application TELESCOPING JOINT FOR USE IN A CONDUIT CONNECTED TO A WELLHEAD AND ZONE ISOLATING TOOL FOR USE THEREWITH filed on Oct. 7, 1997. Zone isolating tool 54 is used to selectively produce oil, for example, from a production zone which produces oil 56, gas 58 and water 60. The apparatus generally indicated by reference 62 is used to stroke the secondary tubing component 14 and the tubing string 24 through a wellhead 64 without removal of the wellhead or killing the well. As explained in applicant's copending application, the motive force for stroking the secondary tubing hanger component 14 and the tubing string 24 through the wellhead 64 is a hydraulic cylinder or jack 66 which is mounted to an upper support plate 70. The upper support plate 70 is supported by support posts 72. The support posts 72 are connected to a lower support plate 74. A travelling support plate 76 slides over and is guided by the support posts 72. A hydraulic motor 78 mounted to the travelling support plate 76 rotates a lift rod string 80. Attached to a free end of the lift rod string 80 is a latch 82 which is used to connect the lift rod string 80 to the secondary tubing hanger component 14 or the tubing string 24. The lift apparatus 62 further includes a pair of blowout preventers 84 and a tool entry spool 86.

The tubing string 24 used with the tubing hanger in accordance with the invention is preferably a flush joint tubing manufactured by Atlas Bradford and available from most oil well equipment suppliers. The use of flush joint tubing is not required if the passage 22 (FIGS. 1,2) in the primary tubing hanger component 12 is large enough to permit joints in the tubing string 24 to reciprocate through the opening.

In preparing to axially displace the tubing string 24, a first step is to position a plug 86 in the tubing string at a position below the last joint to be removed from the tubing string 24. The plug 86 may be inserted using the lift rod string 80. After the plug 86 is inserted, the latch 82 is connected to the lift rod string 80 and the lift rod string 80 is stroked down through the lift apparatus 62, the wellhead 64 and connected to the secondary tubing hanger component 14 or the interior of the tubing string 24 below the secondary tubing hanger component 14. After a connection is made, the secondary tubing hanger component 14 is released from the primary tubing hanger component 12 by operating the hydraulic motor 78 to rotate the lift rod string 80. The amount of rotation will depend on the type of latch mechanism used to secure the secondary tubing hanger component 14 in the cavity 20 of the primary tubing hanger component 12 (FIGS. 1,2). After the secondary tubing hanger component 14 is released from the primary tubing hanger component 12, the secondary tubing hanger component 14 is stroked up through the wellhead and the BOPs 84. As will be understood by those skilled in the art, the BOPs 84 are opened in sequence to permit the secondary tubing hanger component 14 to be stroked out without losing well pressure or permitting hydrocarbons to escape to the atmosphere.

After the secondary tubing hanger component 14 is stroked up through the upper blowout preventer 84, the tubing string is stroked up through the wellhead until a first tubing string joint appears in a tool window 88 of the lift apparatus 62. The tubing string 24 can then be gripped through the tool window 88, which permits the joint to be unscrewed and the joint removed. The latch 82 is then reconnected to the tubing string 24 and a next joint is stroked out through the well. Depending on the joint design, it may be necessary to operate the blowout preventers 84 to let the joints pass through. This process is repeated until the tubing string 24 has been shortened a desired amount. If the tubing string need to be lengthened, a reverse of this procedure is followed.

As will be understood by those skilled in the art, the length of support posts 72 must be adequate to permit a joint of tubing string 24 to be added or removed from the tubing string when the lifting apparatus 62 is used for tubing string displacement. Consequently, for wells where tubing string displacement is anticipated a plurality of "pup" joints having a length of 1–2 meters, for example, can be placed in the tubing string at the top of the well to facilitate displacement and minimize the length required in the support posts 72.

As described above, the tubing hanger in accordance with the invention can be used for any downhole operation in which the position of the tubing string is advantageously or necessarily changed. Those downhole operations include, but are not limited to, selective well stimulations using a zone isolating tool; selective production using a zone isolating tool; barefoot completions; production testing; wireline logging; well abandonments; and the removal of sand or debris from a bottom of the well bore.

For example, to perform a selective well stimulation, the zone isolating tool 54 (FIG. 4) is positioned by axially displacing the tubing string 24 so that an area of a production zone to be stimulated is isolated by the tool. A high-pressure base is then connected to a top end of the tubing string and high-pressure fluids are pumped through the tubing string and into the isolated fluid zone provided by the zone isolating tool 54. After stimulation of the area is complete, the zone isolation tool 54 is relocated and the process is repeated. Since the tubing isolates the wellhead from the high-pressure fluids, the wellhead need not be removed or otherwise protected during the isolation procedure assuming there is an inflatable packer, for example, between the zone isolating tool and the wellhead. This technique also has the advantage that selective stimulation of the zone ensures that all areas of the zone are stimulated, in contrast to a general stimulation treatment where one or more areas of a zone may accept all stimulation fluids while other areas accept none, and therefore remain unstimulated.

To perform selected production using a tubing hanger in accordance with the invention, a zone isolating tool 54 is attached to a bottom end of the tubing string 24. The zone isolating tool is positioned in the well bore by adding tubing string joints and stroking the tubing string down through the wellhead until a position is achieved which permits the production of predominantly a fluid of interest from the well bore. When the zone isolating tool 54 is near the desired position, a pup joint is added to the tubing string, if required, the secondary tubing hanger component is added to a top of the tubing string and the secondary tubing hanger component 14 is seated in the primary tubing hanger component 12 (FIGS. 1 and 2) so that the zone isolating tool is properly positioned to produce the fluid of interest from the well. As a boundary between the fluid of interest and other fluid(s) produced by the production zone changes over time, the positioning process may be repeated to relocate the position of the zone isolating tool 54 within the well bore without removing the wellhead from the well or killing the well. The advantage is fast and simple well servicing with minimal equipment.

A tubing hanger in accordance with the invention may be used for barefoot completions in a manner described in applicant's first-filed copending application. In order to accomplish a barefoot completion, a well bore is first drilled to within a few meters of a target formation. The well bore is cased and headed and a tubing string having a drill bit attached to its bottom end is run into the well in a manner described above. When the drill bit contacts the bottom of the well bore, the bit is driven to drill through the last few meters between the bottom of the bore and the formation. When the bore is completed, the drill bit may be dropped in the bottom of the borehole and production commenced once the bottom end of the tubing string is repositioned and the secondary tubing hanger component 14 is attached to a top end of the tubing string and seated in the primary tubing hanger component 12. The advantage is the ability to perform a barefoot completion with the wellhead on the well and fluid pressures safely contained.

Selected production testing of a well bore may be accomplished using a tubing hanger in accordance with the invention. In order to perform selected production testing, a zone isolation tool 54 is connected to a bottom end of the tubing string 24 and the zone isolating tool 54 is lowered by stroking the tubing string down through the wellhead until the zone isolation tool 54 is positioned in a location of a production zone desired to be tested. Testing may be performed by producing fluid through the tubing string from the selected production zone. After testing is complete, the location of the zone isolation tool 54 is shifted to test another region of the production zone. Such selected testing may be used to determine an optimum position for a zone isolating tool in a production zone that produces at least two fluids of different density. The advantage is the ability to relocate the position of the zone isolating tool with the wellhead in position.

When wireline logging of a well bore is desired, the production tubing is preferably removed from the section of the well bore which requires logging. With prior art wellhead equipment, it is necessary to kill the well, remove the wellhead and pull the tubing from the well before logging can be accomplished without interference from the tubing string. With a wellhead equipped with a tubing hanger in accordance with the invention, as much tubing string as required may be stroked up through the wellhead until a bottom end of the tubing string is above the area of the well bore to be logged. A logging tool may then be run through the tubing string in a manner well known in the art and logging can be accomplished. After logging is completed, the tubing string may be repositioned to a former or new position within the well bore. The advantage is the ability to log a well without removing the wellhead or killing the well in preparation of logging.

When well bores are abandoned, well owners are required by regulation to place cement plugs between each of the production zones in the well. If a well is equipped with a tubing hanger in accordance with the invention, the tubing string can be used to place the required cement plugs as it is withdrawn from the well and the wellhead can be left in place to ensure protection against the escape of hydrocarbons into the atmosphere.

Certain wells produce copious amounts of sand and/or granular debris. It is a common practice in the art in such wells to extend the well bore to form a "sand trap". Sand traps commonly fill with debris which eventually blocks the bottom end of the production tubing and production from the well ceases. When this happens, it is necessary to remove the accumulated debris from the sand trap. With prior art tubing hangers the removal of sand or debris usually requires that the well be killed, the wellhead removed and the tubing string pulled from the well far enough to remove the tubing hanger. After the tubing hanger is removed, blowout preventers are mounted to the tubing head, one or more joints are added to the tubing string and pumping equipment is connected to a top of the tubing string. The tubing string is then lowered in the well as sand and/or debris is pumped out of the well. Once the well is cleaned, the added tubing string joints are removed, the blowout preventers are removed, the tubing hanger is reattached and the wellhead is remounted to the tubing head. The overburden used to kill the well is then removed and normal production may resume.

If the wellhead is equipped with a tubing hanger 10 in accordance with the invention, the tubing string 24 may be stroked upwardly through the wellhead so that the secondary tubing hanger component can be removed. A tubing joint(s) are then added and the tubing string is stroked downwardly as debris is pumped from the sand trap until the well is cleaned of debris. The tubing string may then be returned to a production position and production recommenced without removing the wellhead from the well or killing the well. Time and expense are therefore minimized.

In view of the examples described above, it is apparent that the tubing hanger in accordance with the invention represents a significant advance in the art.

Changes and modifications to the embodiments described above will no doubt become apparent to those skilled in the art. The scope of the invention is therefore intended to be limited solely by the scope of the appended claims.

I claim:

1. A hanger for a tubing string in a cased well equipped with a wellhead, to permit axial displacement of the tubing string through the wellhead, comprising:

a first hanger part engageable with the wellhead for detachably supporting a second hanger part:

the second hanger part being adapted for hanging the tubing string and sized to be stroked up through a central passage in the wellhead with the tubing string attached; and a fluid seal located between the first and second hanger parts to inhibit a flow of fluids therebetween.

2. A hanger for a tubing string in a cased well as claimed in claim 1 wherein the first hanger part has a top and a bottom end, a cavity that extends downwardly from the top end, and a passage that extends upwardly from the bottom end and communicates with the cavity, the passage being sized to accommodate reciprocal movement of the tubing string therethrough.

3. A hanger for a tubing string in a cased well as claimed in claim 2 wherein the second hanger part is adapted to be removably received in the cavity from the top end of the first part, the second hanger part having a bottom end adapted for the connection of the tubing string so that the second part supports the tubing string when received in the cavity.

4. A hanger for a tubing string in a cased well as claimed in claim 3 wherein the hanger further includes a mechanism for locking the second hanger part to the first hanger part.

5. A hanger for a tubing string in a cased well having a wellhead as claimed in claim 4 wherein the mechanism comprises a J-latch which includes at least one pin affixed to one hanger part and at least one receptacle for the at least one pin in the other hanger part.

6. A hanger for a tubing string in a cased well having a wellhead as claimed in claim 5 wherein the at least one pin is affixed to the first hanger part and the receptacle is formed in the second hanger part.

7. A hanger for a tubing string in a cased well having a wellhead as claimed in claim 5 wherein the at least one pin is affixed to the second hanger part and the at least one receptacle is formed in the first hanger part.

8. A hanger for a tubing string in a cased well as claimed in claim 1 wherein the hanger further includes a fluid seal located between the first hanger part and the wellhead to inhibit fluid flow between the wellhead and the first hanger part.

9. A hanger for a tubing string in a cased well as claimed in claim 8 wherein the fluid seal is an elastomeric band that is received in a circumferential groove in an outer surface of the first hanger part.

10. A hanger for a tubing string in a cased well as claimed in claim 8 wherein the fluid seal is a metallic seal for providing a metal-to-metal seal.

11. A hanger for a tubing string in a cased well as claimed in claim 2 wherein the first hanger part further includes a fluid seal in the passage to provide a fluid seal between the first part and the tubing string.

12. A hanger for a tubing string in a cased well having a wellhead, to permit axial displacement of the tubing string through the wellhead, comprising:

a primary tubing hanger component engageable with the wellhead and having a top and a bottom end, a cavity that extends downwardly from the top end, and a passage that extends upwardly from the bottom end and communicates with the cavity, the passage being sized to accommodate reciprocal movement of the tubing string therethrough;

a secondary tubing hanger component adapted to be removably received in the cavity from the top end of the primary tubing hanger component, the secondary tubing hanger component having a bottom end adapted for the connection of the tubing string so that the secondary tubing hanger component supports the tubing string when received in the cavity; and a fluid seal located between the primary and secondary tubing hanger components to inhibit a flow of fluids therebetween.

13. A hanger for a tubing string in a cased well as claimed in claim 12 wherein the apparatus further includes a lock for securing the secondary tubing hanger component within the primary tubing hanger component.

14. A hanger for a tubing string in a cased well as claimed in claim 13 wherein the lock comprises a J-latch which includes opposed pins mounted to one of the components and complimentary receptacles for receiving the lugs in the other of the components.

15. A hanger for a tubing string in a cased well as claimed in claim 14 wherein the pins of the J-latch are mounted to the primary tubing hanger component and the receptacles are formed in the secondary tubing hanger component.

16. A hanger for a tubing string in a cased well as claimed in claim 14 wherein the pins of the J-latch are mounted to the secondary tubing hanger component and the receptacles are formed in the primary tubing hanger component.

17. A hanger for a tubing string in a cased well as claimed in claim 12 wherein the apparatus further includes a seal for inhibiting a flow of fluids between the primary tubing hanger component and the wellhead.

18. A hanger for a tubing string in a cased well as claimed in claim 12 wherein the apparatus further includes a seal for inhibiting a flow of fluids between the passage and the tubing string to inhibit a flow of fluids between the tubing string and the primary tubing hanger component.

19. A hanger for a tubing string in a cased well as claimed in claim 12 wherein the primary and the secondary tubing hanger components are respectively substantially cylindrical.

20. A hanger for a tubing string in a cased well as claimed in claim 12 wherein the primary hanger components is substantially frustoconical.

21. A method of axially displacing a tubing string in a cased well bore without removing a wellhead from the well, comprising the steps of:

a) equipping the wellhead with a tubing hanger which includes at least a first hanger part supported by the wellhead and a second hanger part supported by the first hanger part, the first hanger part supporting the tubing string and sized to be stroked up through a central passage of the wellhead with the tubing string attached;

b) inserting a latch for lifting the second hanger part and the tubing string through the wellhead, and connecting the latch to the tubing string or the second hanger part; and c) stroking the second hanger and a portion of the tubing string through the wellhead.

22. A method of axially displacing a tubing string in a cased well bore as claimed in claim 21, further including the steps of:

d) stroking the second hanger part and a portion of the tubing string through the wellhead until a tubing string joint can be added to or removed from the tubing string, as required;

e) supporting the tubing string so that the lift rod string can be disconnected therefrom;

f) adding or removing a tubing string joint, as required;

g) reattaching the lift rod string and stroking the tubing string in or out of the well as required until another tubing string joint can be added or removed;

h) repeating steps e)–g) until the tubing string has been axially displaced a desired amount; and i) reattaching the second hanger part to the tubing string, stroking the second hanger part and the tubing string through the wellhead until the second hanger part is supported by the first hanger part.

23. A method of axially displacing a tubing string in a cased well bore as claimed in claim 22 further composing a step of disconnecting the second hanger part from the first hanger part before performing step d).

24. A method of axially displacing a tubing string in a cased well bore as claimed in claim 23 wherein the step of disconnecting the second hanger part from the first hanger part involves rotating the second hanger part after the latch means is attached to the second hanger part or the tubing string to release a J-latch which connects the first and second hanger parts.

25. A method of axially displacing a tubing string in a cased well bore as claimed in claim 22 wherein the latch is connected to a lift rod string.

26. A method of axially displacing a tubing string in a cased well bore as claimed in claim 22 wherein the latch comprises any one of a releasing spear, a threaded joint, a slip tool, a releasable packer, a key type tool, a collet type tool, a friction type tool or a rotary taper tap.

27. A method of axially displacing a tubing string in a cased well bore as claimed in claim 23 wherein the tubing string is axially displaced to position a zone isolating tool in order to produce a predominance of a fluid of interest from the well.

28. A method of axially displacing a tubing string in a cased well bore as claimed in claim 23 wherein the tubing string is axially displaced in order to accomplish a barefoot completion of the well.

29. A method of axially displacing a tubing string in a cased well bore as claimed in claim 23 wherein the tubing string is axially displaced in order to remove sand or other accumulated debris from a bottom of the well.

30. A method of axially displacing a tubing string in a cased well bore as claimed in claim 23 wherein the tubing string is axially displaced in order to selectively stimulate the well using a zone isolating tool.

* * * * *